US012599807B2

(12) United States Patent
Singh et al.

(10) Patent No.: US 12,599,807 B2
(45) Date of Patent: Apr. 14, 2026

(54) CHAIR EXERCISE APPARATUS

(71) Applicant: BALANCED BODY, INC., Sacramento, CA (US)

(72) Inventors: Harbir Singh, Roseville, CA (US); Yunhui Liu, Sacramento, CA (US)

(73) Assignee: Balanced Body, Inc., Sacramento, CA (US)

( * ) Notice: Subject to any disclaimer, the term of this patent is extended or adjusted under 35 U.S.C. 154(b) by 92 days.

(21) Appl. No.: 18/806,883

(22) Filed: Aug. 16, 2024

(65) Prior Publication Data

US 2026/0048291 A1 Feb. 19, 2026

(51) Int. Cl.
*A63B 21/16* (2006.01)
*A47C 9/00* (2006.01)

(52) U.S. Cl.
CPC ..... *A63B 21/1609* (2015.10); *A47C 9/002* (2013.01); *A63B 2208/0233* (2013.01)

(58) Field of Classification Search
CPC . A63B 21/1609; A63B 21/16; A63B 21/1672; A63B 21/4029; A63B 21/4031; A63B 2210/02; A63B 2210/04; A63B 2210/50; A63B 2208/0233; A47C 9/002
See application file for complete search history.

(56) References Cited

U.S. PATENT DOCUMENTS 5,090,694 A * 2/1992 Pauls ..... A63B 21/015 482/904
6,685,602 B2 2/2004 Colosky, Jr.
6,916,279 B2 * 7/2005 Endelman ..... A63B 23/03541 482/137
6,929,589 B1 8/2005 Bruggemann
7,294,096 B1 * 11/2007 Stearns ..... A63B 21/4047 482/121

(Continued)

FOREIGN PATENT DOCUMENTS

CN 201150393 Y 11/2008
CN 203355205 U * 12/2013

(Continued)

OTHER PUBLICATIONS

International Search Report and Written Opinion for International Application No. PCT/US2023/067816, mailed Dec. 7, 2023, 14 pages.

*Primary Examiner* — Megan Anderson
*Assistant Examiner* — Kathleen M Fisk
(74) *Attorney, Agent, or Firm* — Greenberg Traurig, LLP

(57) ABSTRACT

A chair exercise apparatus has a frame, an inverted Y shaped seat support member fastened to an upper portion of the frame, a seat fastened to an upper end of the seat support, and a pair of parallel arms each having a proximal end extending toward the frame and a foot support fastened to a distal end of each arm. Each arm is biased upward away from the frame. A pair of hinged support post members is fastened to a mounting bracket captured between the seat and the upper end of the inverted Y shaped seat support and each is movable from a storage position below an upper surface of the seat to an operable position extending upward alongside the seat and each member is releasably captured in the operable position by a clamp formed between the short leg and its end portion of the mounting bracket.

20 Claims, 5 Drawing Sheets

(56) References Cited

U.S. PATENT DOCUMENTS

| | | | | |
|---|---|---|---|---|
| 7,361,127 | B2 * | 4/2008 | Tremayne | A63B 21/055 482/121 |
| 7,635,323 | B2 * | 12/2009 | Halbridge | A63B 23/03541 482/121 |
| 7,794,378 | B2 * | 9/2010 | Splane, Jr. | A63B 21/02 482/148 |
| 8,613,692 | B2 * | 12/2013 | Baudhuin | A63B 21/023 482/121 |
| 9,220,939 | B2 * | 12/2015 | Chen | A63B 21/4031 |
| 9,474,922 | B2 * | 10/2016 | Magrella | A63B 21/00065 |
| 9,573,012 | B1 * | 2/2017 | Lee | A63B 23/03525 |
| 9,757,615 | B2 * | 9/2017 | Walkama | A63B 71/0036 |
| D1,087,258 | S * | 8/2025 | Endelman | D21/676 |
| D1,089,463 | S * | 8/2025 | Endelman | D21/676 |
| D1,093,512 | S * | 9/2025 | Endelman | D21/676 |
| 2002/0142898 | A1 * | 10/2002 | Willis | A63B 21/1609 482/904 |
| 2008/0081748 | A1 * | 4/2008 | Knapp | A63B 21/4043 482/130 |
| 2009/0227434 | A1 | 9/2009 | Baudhuin | |
| 2014/0274603 | A1 * | 9/2014 | Howes | A63B 23/03525 482/127 |
| 2024/0009507 | A1 * | 1/2024 | Endelman | A63B 22/0089 |
| 2024/0398125 | A1 * | 12/2024 | Endelman | A47C 9/002 |
| 2025/0248525 | A1 * | 8/2025 | Deng | A47C 7/70 |

FOREIGN PATENT DOCUMENTS

| | | | |
|---|---|---|---|
| DE | 69310914 | T2 | 3/1998 |
| GB | 2482136 | A | 1/2012 |
| WO | 8400496 | A1 | 2/1984 |
| WO | 2006008766 | A1 | 1/2006 |

* cited by examiner

CHAIR EXERCISE APPARATUS

BACKGROUND

The present disclosure relates to an exercise apparatus used in Pilates type exercises. In particular, this disclosure relates to a new Pilates chair that has a number of unique innovations.

Exercise machines utilized in the performance of physical exercises originated by Joseph Pilates typically are often performed on a stationary apparatus called a reformer. Other exercises are conducted on a combo chair that has spring biased foot bar rests or bars on ends of arms which extend out from a pivot bar fixed to a bottom of the chair frame beneath the chair. One or two coil springs extend from beneath a rear of the chair or the chair seat to a point on each of the arms close to the foot rests.

Typically a user presses against the foot bars or rests while either sitting on the chair or standing with both legs or one leg resting on the seat and the other pushing on the foot pad/bar at the ends of the arms. One such chair, called a combo chair, is disclosed in our U.S. Pat. No. 6,919,279. Spring tension is generally limited to the spring rate of typically one or at most two springs attached between the chair frame and each of the arms. One solution has been the anchor configuration set out in our U.S. Pat. No. 6,919,279 which permits a rear end of each of the springs to be attached at three different heights at the rear of the combo chair. This has expanded the versatility of the Combo Chair but still limits the versatility of the combo chair to a relatively limited number of exercises without having to change out the coil springs. Thus there is a need for a more versatile chair that can provide a wider range of tensions between the chair seat and the foot support pads/bars at the ends of the arms that pivot from beneath the chair.

A chair exercise apparatus that addresses the above needs is disclosed in US Patent Publication No. 2024/0009507 filed Jun. 2, 2023, the content of which is incorporated by reference herein.

SUMMARY OF THE DISCLOSURE

One exemplary embodiment of a chair exercise apparatus in accordance with the present disclosure has a U shaped frame configured to rest on a horizontal surface such as a floor, an inverted Y shaped seat support fastened to an upper surface portion of the frame, a seat fastened to an upper end of the inverted Y shaped seat support, a pair of parallel foot support arms each having a proximal end extending toward the frame and a foot support fastened to a distal end of each of the pair of parallel arms, wherein each foot support arm is biased away from the frame toward the seat, and a pair of hinged support post members each fastened to opposite end portions of a mounting bracket captured between the seat and the upper end of the inverted Y shaped seat support. Each support post member is movable from a storage position below an upper surface of the seat to an operable position extending upward alongside the seat.

An embodiment of a chair exercise apparatus in accordance with the present disclosure may be viewed as including a frame configured to rest on a horizontal surface, an inverted Y shaped seat support fastened to an upper surface portion of the frame, a seat fastened to an upper end of the inverted Y shaped seat support, a pair of parallel foot support arms each having a proximal end extending toward the frame and a foot support fastened to a distal end of each of the pair of parallel foot support arms, wherein each foot support arm is biased away from the frame toward the seat, and a pair of hinged support post members each fastened to a mounting bracket captured between the seat and the upper end of the inverted Y shaped seat support.

This mounting bracket has opposing end portions. Each support post member is movable from a storage position below an upper surface of the seat to an operable position extending upward alongside the seat. Each hinged support post member has a long leg and a short leg extending at an angle from the long leg. The short leg is hinged to one of the opposing end portions of the mounting bracket.

Each support post member is releasably captured in the operable position by a clamp formed between the short leg of one of the hinged support post members and one of the opposing end portions of the mounting bracket via a link rotatably fastened for rotation preferably about a horizontal axis to one of the opposing end portions of the mounting bracket.

The chair exercise apparatus may include a clip link rotatably fastened parallel to one of the opposing end portions of the mounting bracket. The clip link preferably has a U shaped portion carrying a spring loaded lock knob for clamping a flange portion of the short leg of one of the hinged support post members to one of the opposing end portions of the mounting bracket so as to form the clamp between the short leg and one of the opposing end portions when that hinged support post member is in the operable position. Each support post member long leg preferably includes a handle with a stem telescopically received in a tubular handle receiver. The tubular handle receiver is rigidly attached to the short leg. In a preferred embodiment, the short leg includes parallel sides with a flange portion therebetween and the parallel sides are rotatably fastened to one of the opposing end portions of the mounting bracket. In one embodiment the short leg is rigidly fastened to the tubular handle receiver. The clip link preferably has a stem portion joining the U shaped portion, and the stem portion is rotatably fastened to one of the opposing end portions of the mounting bracket so as rotate about an axis through that end portion of the mounting bracket. Furthermore, in a preferred embodiment, the clip link is rotatable about a vertical axis through one end portion of the mounting bracket.

In one embodiment, the U shaped portion of the clip link holds the flange portion of the short leg of that hinged support post member to that one end portion of the mounting bracket when that hinged support post member is in the operable position. In one embodiment, the short leg is a solid body having a flange portion and a pair of parallel sides configured to straddle one of the opposing end portions of the mounting bracket. The short leg is rigidly attached to the tubular handle receiver.

In one embodiment the chair exercise apparatus includes a clip link rotatably fastened parallel to one of the opposing end portions of the mounting bracket, wherein the clip link has a U shaped portion for wrapping around the flange portion and one end portion of the mounting bracket, the U shaped portion carrying a spring loaded lock knob for clamping a flange portion of the short leg of a hinged support post member to the one end portion of the mounting bracket forming the clamp between the short leg and one of the opposing end portions when one of the hinged support post members is in the operable position. The clip link has a stem portion rotatably fastened to one end portion of the mounting bracket.

In an exemplary embodiment, the chair exercise apparatus includes a frame configured to rest on a horizontal surface, a seat support fastened to an upper surface portion of the frame, a seat fastened to an upper end of the seat support spacing the seat above the horizontal surface, a pair of parallel foot support arms each having a proximal end extending toward the frame and a foot support fastened to a distal end of each of the pair of parallel foot support arms, wherein each foot support arm is biased away from the frame toward the seat, and a pair of hinged support post members each fastened to a mounting bracket captured between the seat and the seat support. In this exemplary embodiment, the mounting bracket has opposing end portions and each support post member is movable from a storage position below the seat to an operable position extending upward alongside the seat. Each hinged support post member has a long leg and a short leg extending at an angle from the long leg, the short leg being hinged to one of the opposing end portions of the mounting bracket. Each support post member is releasably captured in the operable position by a clamp formed between the short leg and one of the opposing end portions of the mounting bracket by a clip link rotatably fastened for rotation about a vertical axis to one of the opposing end portions of the mounting bracket. The proximal end of each of the pair of parallel foot support arms is fastened to a rotary arm torque unit mounted beneath the seat.

An exemplary embodiment of a chair exercise apparatus in accordance with this disclosure preferably includes a frame configured to rest on a horizontal surface, an inverted Y shaped seat support fastened to an upper surface portion of the frame, a seat fastened to an upper end of the inverted Y shaped seat support, and a pair of hinged hand support post members each fastened to a mounting bracket captured between the seat and the upper end of the inverted Y shaped seat support. This mounting bracket has opposing end portions and each support post member is movable from a storage position below an upper surface of the seat to an operable position extending upward alongside the seat.

Each hinged hand support post member has a long leg and a short leg extending at an angle from the long leg, the short leg being hinged to one of the opposing end portions of the mounting bracket. Each support post member is releasably captured in the operable position by a clamp formed between the short leg and one of the opposing end portions of the mounting bracket. This clamp is formed by a clip link rotatably fastened to one of the opposing end portions of the mounting bracket, the clip link carrying a spring loaded lock knob for clamping a flange portion of the short leg to one end portion of the opposing end portions of the mounting bracket forming the clamp between the short leg and one of the opposing end portions of the mounting bracket when a hinged support post member is in the operable position.

Each hinged hand support post member has a long leg and a short leg extending at an angle from the long leg, the short leg being hinged to one of the opposing end portions of the mounting bracket, and each support post member is releasably captured in the operable position by a clamp formed between the short leg and one of the opposing end portions of the mounting bracket. Each long leg includes a handle with a stem telescopically received in a tubular handle receiver. The tubular handle receiver is rigidly fastened to the short leg. The short leg includes a link rotatably hinged to one of the opposing end portions of the mounting bracket.

BRIEF DESCRIPTION OF THE DRAWING

These and other features and advantages of embodiments of the present disclosure will become more apparent from a reading of the following detailed description when taken in conjunction with the drawings.

DETAILED DESCRIPTION

Figure 1:
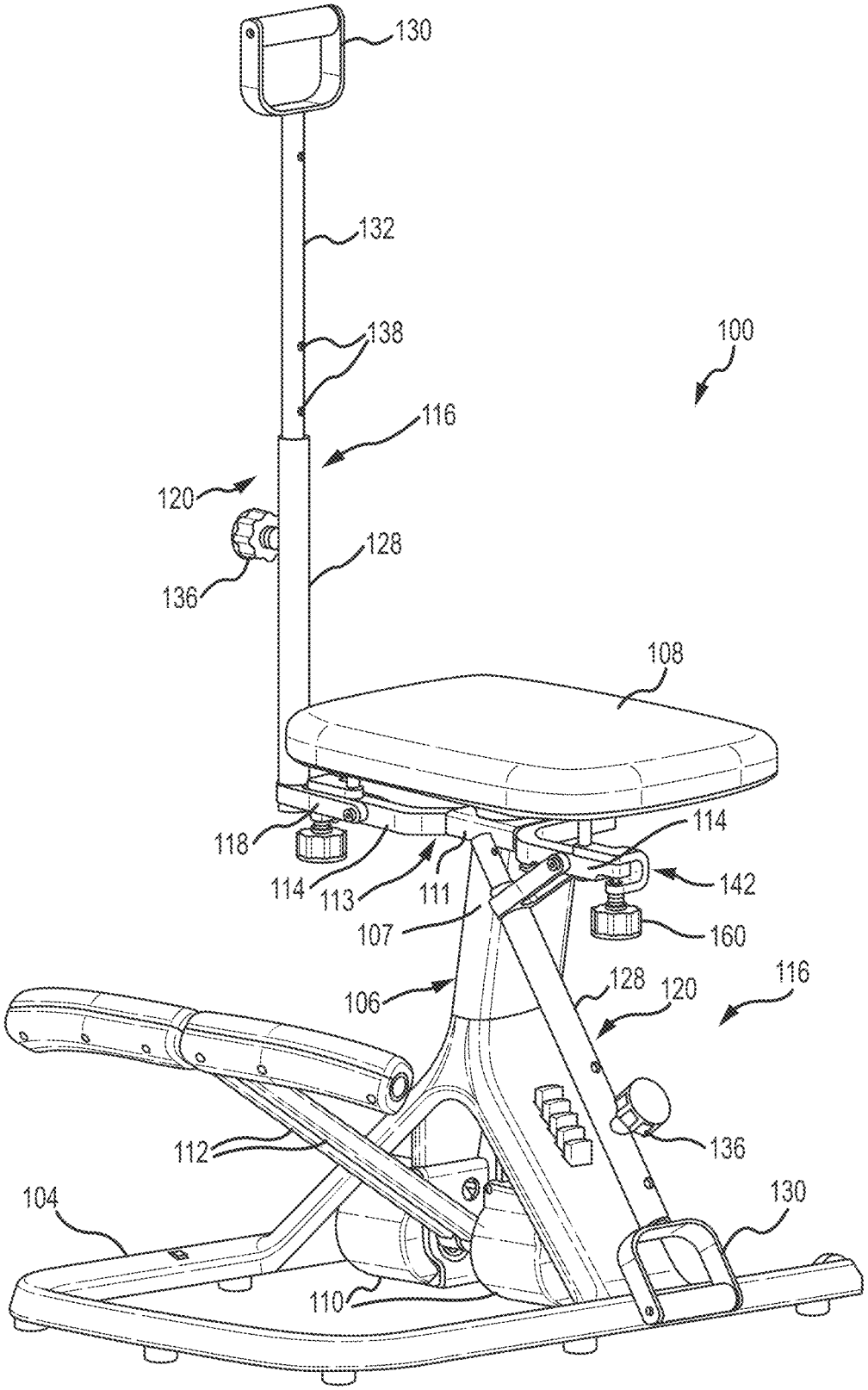
FIG. 1 is a front perspective view of a chair exercise apparatus in accordance with the present disclosure having foldable hand support posts.
Figure 2:
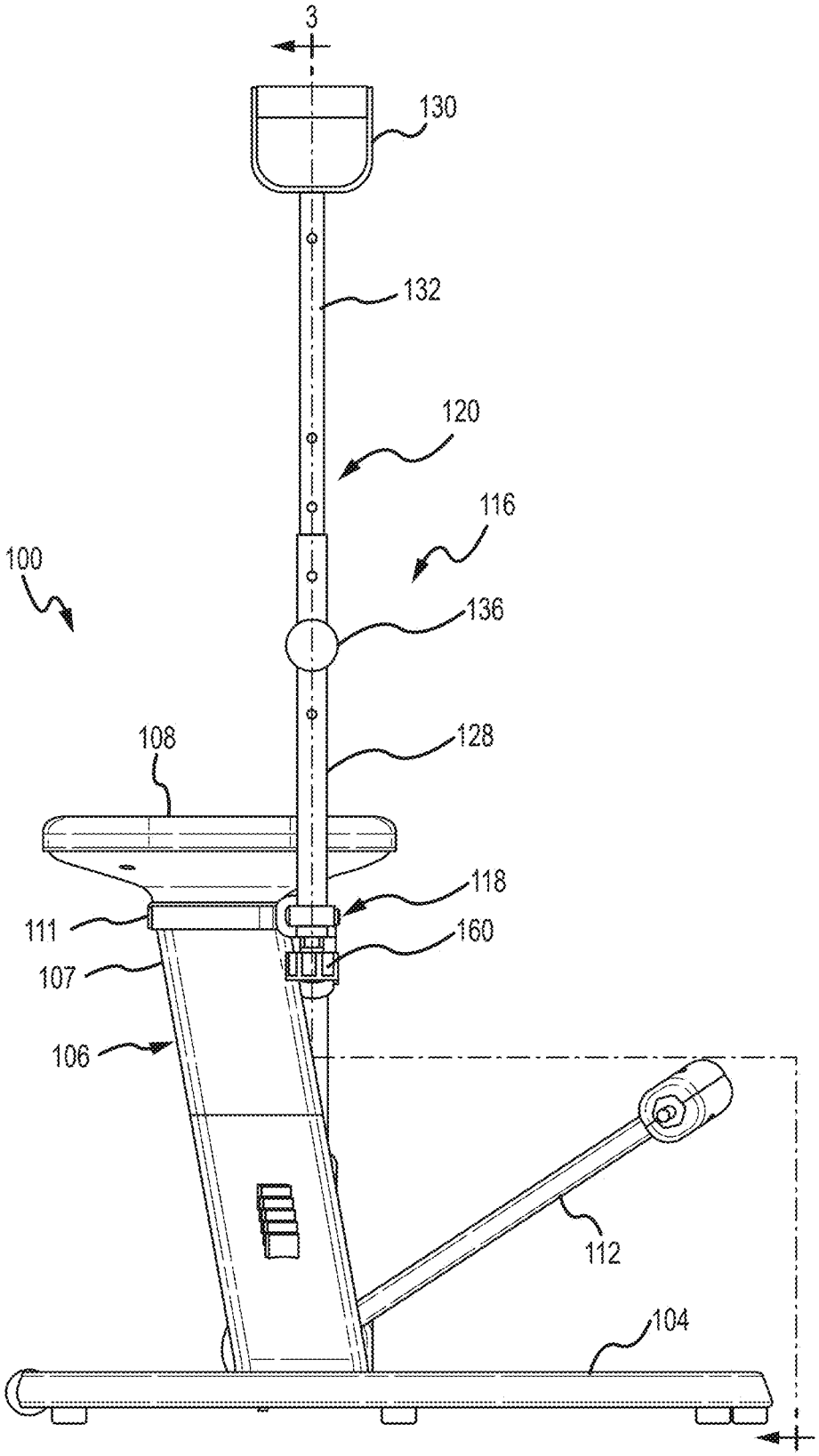
FIG. 2 is a right side view of the chair exercise apparatus shown in FIG. 1.
Figure 3:
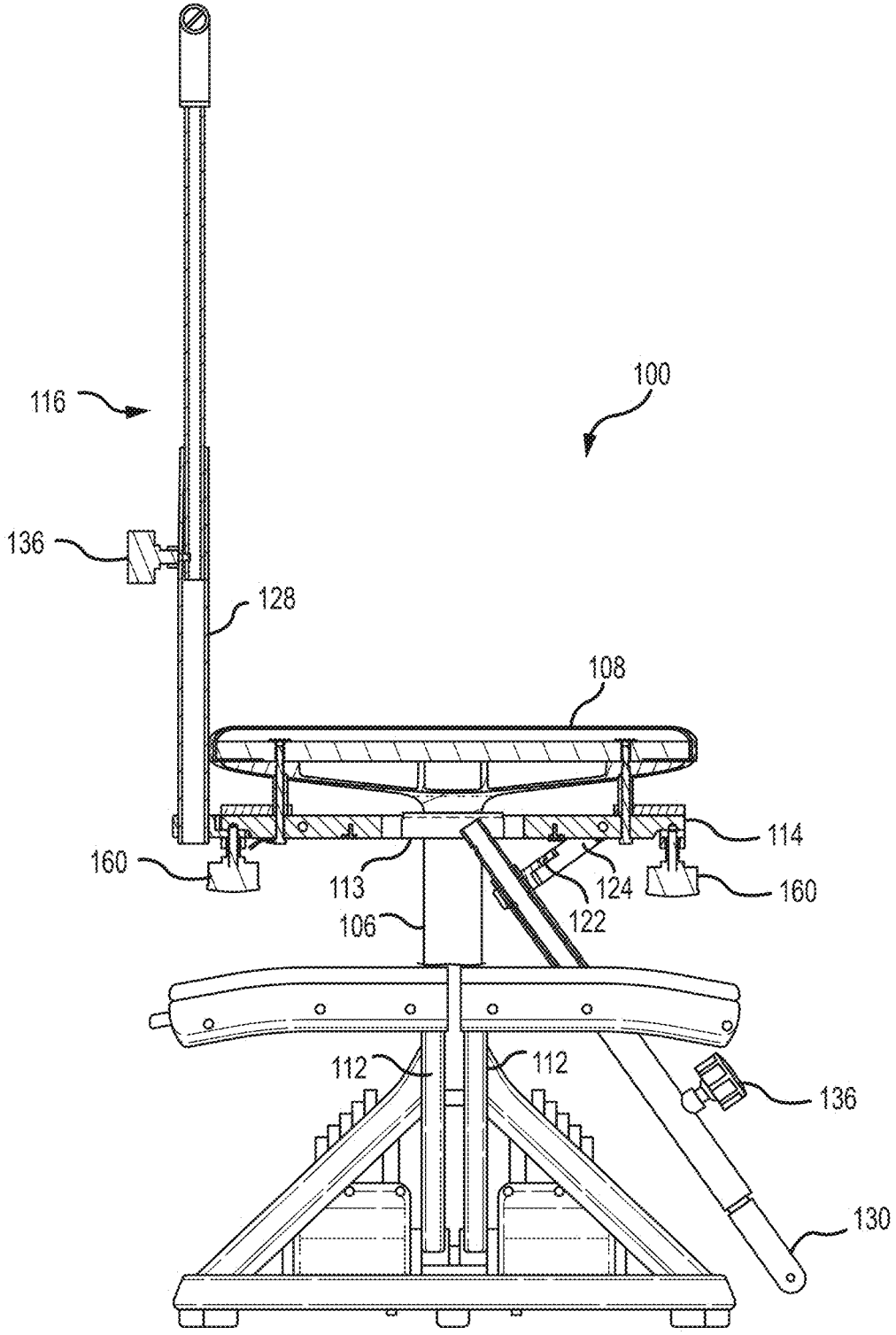
FIG. 3 is a partial front sectioned view of the chair exercise apparatus shown in FIG. 1 taken along the line 3-3 in FIG. 2.
Figure 4:
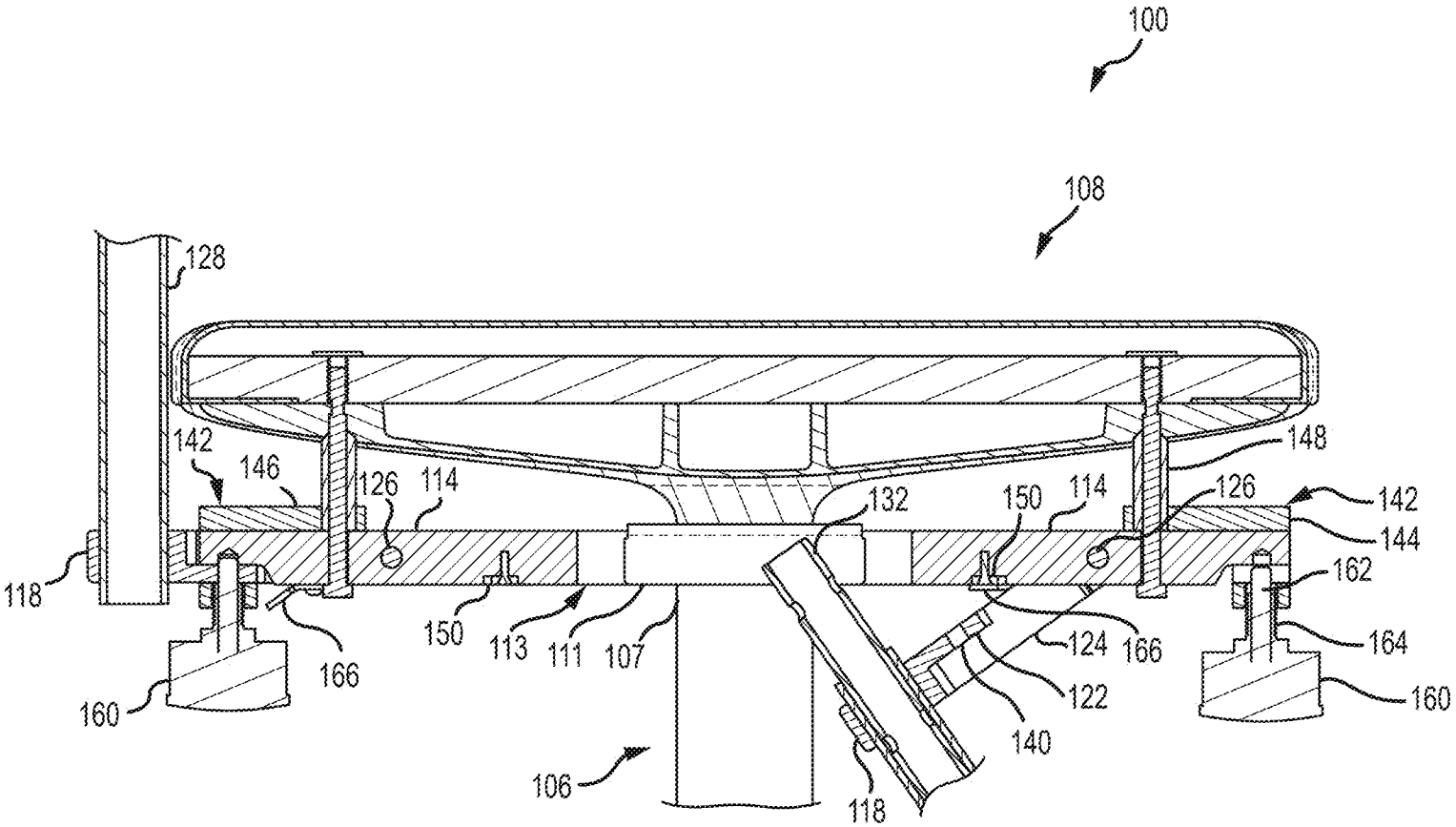
FIG. 4 is an enlarged portion of the partial sectional view of the chair exercise apparatus shown in FIG. 3.

One exemplary embodiment of a chair exercise apparatus 100 in accordance with the present disclosure is shown in a perspective front view in FIG. 1. A right side view of the chair exercise apparatus 100 is shown in FIG. 2. A front view of the chair exercise apparatus 100 is shown in FIG. 3. The chair exercise apparatus 100 in this embodiment has a frame including a generally U shaped bottom frame member 104, configured to rest upon a horizontal surface such as a studio floor, an inverted Y shaped seat support member 106 fastened to the generally U shaped bottom frame member 104, a seat 108 fastened to an upper end portion of the inverted Y shaped seat support member 106, and a pair of elongated parallel foot rest support arm members 112 each having a proximal end extending downward toward the generally U shaped frame member 104 and joined to a rotary arm torque unit 110 beneath the inverted Y shaped seat support member 106. These foot rest support arm members 112 extend upward and outward away from the generally U shaped bottom frame member 104 beneath the inverted Y shaped seat support member 106 and the spaced pair of rotary arm torque units 110 fastened to the generally U shaped bottom frame member 104. Each rotary arm torque unit 110 independently and resiliently biases one of the footrest support arm members 112 away from the generally U shaped bottom frame member 104 upward toward the seat 108.

The seat 108 is fastened to a center portion 111 of a seat mounting bracket 113 fastened between the seat 108 and the upper end or stem 107 of the inverted Y shaped seat support member 106. The seat support bracket 113 has a pair of opposing end portions 114 extending in opposite directions from the center portion 111 of the bracket 113. Each end portion 114 of the bracket 113 carries a hinged hand support post member 116. Each hinged hand support post member 116 includes a short leg 118 and a long leg 120 extending at a fixed angle from the short leg 118. Preferably this fixed angle is a right angle. Each hinged hand support member 116 is movable from a storage position below an upper surface of the seat 108 to an operable position extending upward alongside the seat 108. In FIGS. 1-4, one hinged hand support post member 116 is shown in the operable position extending upward alongside the seat 108 and the other hinged hand support post member 116 is shown in the storage position.

Each hinged hand support post member 116 is releasably captured in the operable position by a link that forms a clamp between the short leg 118 and the end portion 114 of the bracket 113 as will be explained in further detail below. The short leg 118 of the support post member 116 is a solid body having a flange portion 122 between parallel sides 124 that receive the end portion 114 of the mounting bracket 113 therebetween. These sides 124 are pivotably fastened to the end portion 114 of the bracket 113 by a pin 126 on a horizontal axis through the end portion 114 such that the sides 124 can rotate in a vertical arc about the end portion 114 of the bracket 113 to move the hinged hand support post member 116 from the storage position to the operable position.

The short leg 118 of the hinged support post member 116 is fixedly attached to a tubular handle receiver 128 forming part of the long leg 120 of the support post member 116. A handle 130 having a stem portion 132 is telescopically received in the tubular handle receiver 128. The handle 130 on the stem portion 132 may be positioned at any one of several positions above the seat 108 by engaging a spring loaded lock pin member 136 near the distal end of the tubular handle receiver 128 into one of a series of spaced holes 138 in the stem portion 132.

Each short leg 118 has parallel legs or sides 124 configured to vertically sandwich or straddle one of the end portions 114 of the mounting bracket 113. The short leg 118 also has a flange portion 122 spanning between the parallel legs or sides 124. This flange portion 122 has a radial bore 140 therethrough. Each short leg 118 also carries a U shaped steel sheet metal retaining member 166 fastened to each of the sides 124 of the short leg 118 that engages a magnet 150 fixed to the underside of the end portion 114 of the mounting bracket 113 when the hinged hand support member 116 is placed in a storage position below the seat 108. This retaining member 166, when engaged with the magnet 150, holds the hand support post member 116 stationary while a user is exercising on the chair exercise apparatus 100 when the support post members 116 are not needed and/or during transport and/or storage of the chair exercise apparatus 100.

Figure 5C:
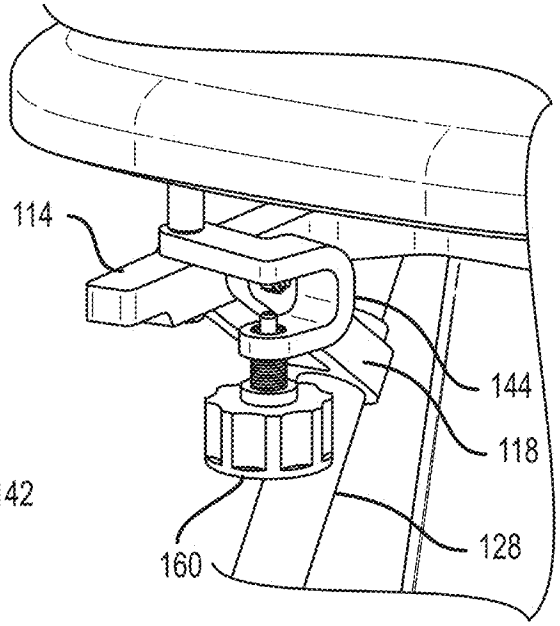
FIG. 5C is a partial perspective view of the chair exercise apparatus with the foldable hand support post member lowered to the storage position.
Figure 5B:
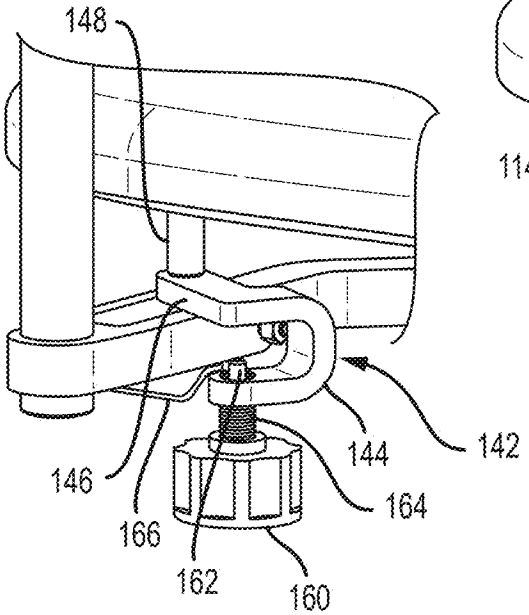
FIG. 5B is a partial perspective view as in FIG. 5A with the clip link loosened and rotated out of engagement with the short leg of the foldable hand support post member.
Figure 5A:
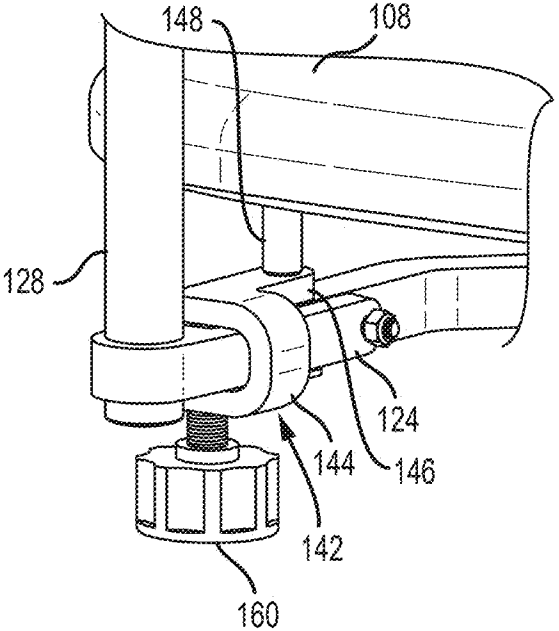
FIG. 5A is a closeup partial perspective view of the chair exercise apparatus with the clip link engaged with the short leg of the foldable hand support post member to lock the support post member in the operating position.

FIGS. 5A-5C show a closeup view of the engagement arrangement of the short leg 118 of the hinged hand support post member 116 to one of the end portions 114 of the mounting bracket 113. A clip link 142 is rotatably fastened parallel to each one of the opposing end portions 114 of the mounting bracket 113 so as to rotate about a vertical axis through the end portion 114. This clip link 142 has a U shaped portion 144 for wrapping around the short leg 118 when the hinged support post member 116 is in the operable position as shown in FIG. 5A and a straight stem portion 146. The stem portion 146 of the clip link 142 is rotatably fastened to a vertical seat support strut 148 extending preferably vertically between the end portion 114 of the mounting bracket 113 and the seat 108.

The U shaped portion of the clip link 142 carries a spring loaded locking knob 160 fastened thereto. This spring loaded locking knob 160 has a spring loaded central pin 162 that slides within a threaded sleeve 164 of the locking knob 160 carried by the U shaped portion 144 of the clip link 142.

When the hinged support post member 116 is in the operable position, shown in FIG. 5A, the short leg 118 is parallel to the end portion 114 of the mounting bracket 113 and the flange portion 122 of the short leg 118 is clamped to the end portion 114 by the U shaped portion 144 of the clip link 142. The spring loaded locking knob 160 carried by the U shaped portion 144 is then tightened to rigidly hold the short leg 118 and the end portion 114 together.

When the locking knob 160 is loosened the central pin 162 can be withdrawn by pulling down on the locking knob 160 to withdraw the pin 162 from the bore 140 through the flange portion 122 and permit rotation of the clip link 142 horizontally out of engagement with the end portion 114 and the flange portion 122 of the short leg 118 as is shown in FIG. 5B. The hinged hand support post member 116 can then be vertically rotated from the operable position to the storage position as shown in FIG. 5C.

There are many variations and alternatives to the particular structure described above which are within the scope of the present disclosure. For example, the spring loaded locking pin member 136 on the distal end of the tubular handle receiver 128 which engages the holes 138 in the handle stem portion 132 may be replaced with any one of a number of locking mechanisms for fixing telescoping members. The steel retaining member 166 and magnet 150 may be replaced by a mechanical latch to keep the hinged hand support post member 116 in the storage position.

The chair exercise apparatus 100 may be constructed without an inverted Y shaped seat support post as shown. For example, the chair exercise apparatus could have parallel supports or a box shaped support between the bottom of the frame and the seat 108. In such an alternative the hinged hand support post members 116 would be carried on a mounting bracket differently shaped from that as shown. However, structure and operation of the hinged hand support post members 116 would be similarly arranged. Accordingly, all such alternatives, variations and modifications are intended to be encompassed within the scope of this disclosure and as defined by the following claims.

What is claimed is:

1. A chair exercise apparatus comprising:

a frame configured to rest on a horizontal surface;

an inverted Y shaped seat support fastened to an upper surface portion of the frame;

a seat fastened to an upper end of the inverted Y shaped seat support;

a pair of parallel foot support arms each having a proximal end extending toward the frame and a foot support fastened to a distal end of each of the pair of parallel foot support arms, wherein each foot support arm is biased away from the frame toward the seat; and a pair of hinged support post members each fastened to a mounting bracket captured between the seat and the upper end of the inverted Y shaped seat support, the mounting bracket having opposing end portions, wherein each support post member is movable from a storage position below an upper surface of the seat to an operable position extending upward alongside the seat, wherein each hinged support post member has a long leg and a short leg extending at an angle from the long leg, the short leg being hinged to one of the opposing end portions of the mounting bracket;

wherein each support post member is releasably captured in the operable position by a clamp formed between the short leg of one of the hinged support post members and one of the opposing end portions of the mounting bracket.

2. The chair exercise apparatus according to claim 1 wherein each support post member long leg includes a handle with a stem telescopically received in a tubular handle receiver and the short leg of at least one of the pair of hinged support post members includes a link rotatably fastened for rotation about a horizontal axis to one of the opposing end portions of the mounting bracket.

3. The chair exercise apparatus according to claim 2 wherein the short leg of one of the pair of hinged support post members is a solid body having a flange portion and a pair of parallel sides configured to straddle one of the opposing end portions of the mounting bracket.

4. The chair exercise apparatus according to claim 3 wherein the short leg of at least one of the pair of hinged support post members is rigidly attached to the respective tubular handle receiver.

5. The chair exercise apparatus according to claim 4 further comprising a clip link rotatably fastened parallel to one of the opposing end portions of the mounting bracket, wherein the clip link has a U shaped portion for wrapping around the flange portion of the short leg of one of the pair of hinged support post members and one end portion of the mounting bracket, the U shaped portion carrying a spring loaded lock knob for clamping the flange portion of the short leg of that one of the pair of hinged support post members to the one end portion of the mounting bracket when that one of the hinged support post members is in the operable position.

6. The chair exercise apparatus according to claim 5 wherein the clip link has a stem portion rotatably fastened to one end portion of the mounting bracket.

7. The chair exercise apparatus according to claim 2 wherein the short leg of one of the pair of hinged support post members includes parallel sides with a flange portion therebetween and the parallel sides are rotatably fastened to one of the opposing end portions of the mounting bracket.

8. The chair exercise apparatus according to claim 7 wherein the short leg of at least one of the pair of hinged support post members is rigidly fastened to the respective tubular handle receiver.

9. The chair exercise apparatus according to claim 2 wherein the tubular handle receiver of one of the pair of hinged support post members is rigidly attached to the respective short leg.

10. The chair exercise apparatus according to claim 1 further comprising a clip link rotatably fastened parallel to one of the opposing end portions of the mounting bracket, wherein the clip link has a U shaped portion carrying a spring loaded lock knob for clamping a flange portion of the short leg of one of the hinged support post members to one of the opposing end portions of the mounting bracket forming the clamp between the short leg and one of the opposing end portions when that hinged support post member is in the operable position.

11. The chair exercise apparatus according to claim 10 wherein each support post member long leg includes a handle with a stem telescopically received in a tubular handle receiver.

12. The chair exercise apparatus according to claim 11 wherein the clip link has a stem portion joining the U shaped portion, and the stem portion is rotatably fastened to one of the opposing end portions of the mounting bracket so as rotate about an axis through that end portion of the mounting bracket.

13. The chair exercise apparatus according to claim 12 wherein the clip link is rotatable about a vertical axis through one end portion of the mounting bracket.

14. The chair exercise apparatus according to claim 13 wherein the U shaped portion of the clip link holds the flange portion of the short leg of that hinged support post member to that one end portion of the mounting bracket when that hinged support post member is in the operable position.

15. A chair exercise apparatus comprising:

a frame configured to rest on a horizontal surface;

a seat support fastened to an upper surface portion of the frame;

a seat fastened to an upper end of the seat support spacing the seat above the horizontal surface;

a pair of parallel foot support arms each having a proximal end extending toward the frame and a foot support fastened to a distal end of each of the pair of parallel foot support arms, wherein each foot support arm is biased away from the frame toward the seat; and a pair of hinged support post members each fastened to a mounting bracket captured between the seat and the seat support, the mounting bracket having opposing end portions, wherein each support post member is movable from a storage position below the seat to an operable position extending upward alongside the seat, wherein each hinged support post member has a long leg and a short leg extending at an angle from the long leg, the short leg being hinged to one of the opposing end portions of the mounting bracket;

wherein each support post member is releasably captured in the operable position by a clamp formed between the short leg and one of the opposing end portions of the mounting bracket by a clip link rotatably fastened for rotation about a vertical axis to one of the opposing end portions of the mounting bracket.

16. The chair exercise apparatus according to claim 15 wherein the seat support is an inverted Y shaped seat support fastened to an upper surface portion of the frame.

17. The chair exercise apparatus according to claim 16 wherein the proximal end of each of the pair of parallel foot support arms is fastened to a rotary arm torque unit mounted beneath the seat.

18. The chair exercise apparatus according to claim 15 wherein the proximal end of each of the pair of parallel foot support arms is fastened to a rotary arm torque unit mounted beneath the seat.

19. A chair exercise apparatus comprising:

a frame configured to rest on a horizontal surface;

an inverted Y shaped seat support fastened to an upper surface portion of the frame;

a seat fastened to an upper end of the inverted Y shaped seat support; and a pair of hinged support post members each fastened to a mounting bracket captured between the seat and the upper end of the inverted Y shaped seat support, the mounting bracket having opposing end portions, wherein each support post member is movable from a storage position below an upper surface of the seat to an operable position extending upward alongside the seat, wherein each hinged support post member has a long leg and a short leg extending at an angle from the long leg, the short leg being hinged to one of the opposing end portions of the mounting bracket;

wherein each support post member is releasably captured in the operable position by a clamp formed between the short leg and one of the opposing end portions of the mounting bracket.

20. The chair exercise apparatus according to claim 19 wherein the clamp on at least one of the pair of hinged support members is formed by a clip link rotatably fastened to one of the opposing end portions of the mounting bracket, the clip link carrying a spring loaded lock knob for clamping a flange portion of the short leg of that one of the pair of hinged support members to one end portion of the opposing end portions of the mounting bracket when that one of the pair of hinged support post member is in the operable position.

* * * * *